US005097244A

United States Patent [19]

Veverka et al.

[11] Patent Number: 5,097,244

[45] Date of Patent: Mar. 17, 1992

[54] BUS MOUNTED CAPACITOR EXPULSION-TYPE FUSES

[75] Inventors: Edward F. Veverka; Gary L. Goedde; Marco J. Mason, all of Racine; John Lapp, Franklin, all of Wis.

[73] Assignee: Cooper Industries, Inc., Houston, Tex.

[21] Appl. No.: 631,142

[22] Filed: Dec. 20, 1990

[51] Int. Cl.[5] ..... H01H 71/20; H01H 85/02

[52] U.S. Cl. ..... 337/217; 337/173; 337/203

[58] Field of Search ..... 337/202, 217, 249, 281, 337/282, 218, 219, 203, 173

[56] References Cited

U.S. PATENT DOCUMENTS

| | | | |
|---|---|---|---|
| 2,094,013 | 9/1937 | Hill | 337/217 |
| 2,340,055 | 1/1944 | Halbrook . | |
| 2,877,320 | 3/1959 | Hill | 337/173 |
| 3,575,683 | 4/1971 | Fahnoe . | |
| 3,710,212 | 1/1973 | Marek et al. . | |
| 3,868,617 | 2/1975 | Dragon et al. . | |
| 4,503,414 | 3/1985 | Sykes et al. . | |
| 4,885,561 | 12/1989 | Veverka et al. . | |
| 4,970,619 | 11/1990 | Veverka et al. . | |

OTHER PUBLICATIONS

McGraw Edison Company, Power Systems Division, Apparatus Catalog 230-30, Feb. 1978 (p. 5).

*Primary Examiner*—Harold Broome

*Attorney, Agent, or Firm*—Wigman & Cohen

[57] ABSTRACT

An electrical fault protective device for providing power interruption in electrical circuits rated up to 10,000 amperes and above. The device comprises a single- or double-vented expulsion-type fuse, connected at one vented end to a hollow bus and at the other end to a conductive expansion chamber for a double-vent fuse or an electrical contact for a single-vent fuse. A spring located in the hollow bus is attached to the fusible link for pulling the fusible link from the fuse tube to rapidly extinguish the arc when the fuse blows. The fuse tube is also retractable into the hollow bus when the fuse blows to provide a visual indication of fuse operation and to relieve the dielectric stress on the fuse tube.

28 Claims, 6 Drawing Sheets

FIG. 1A
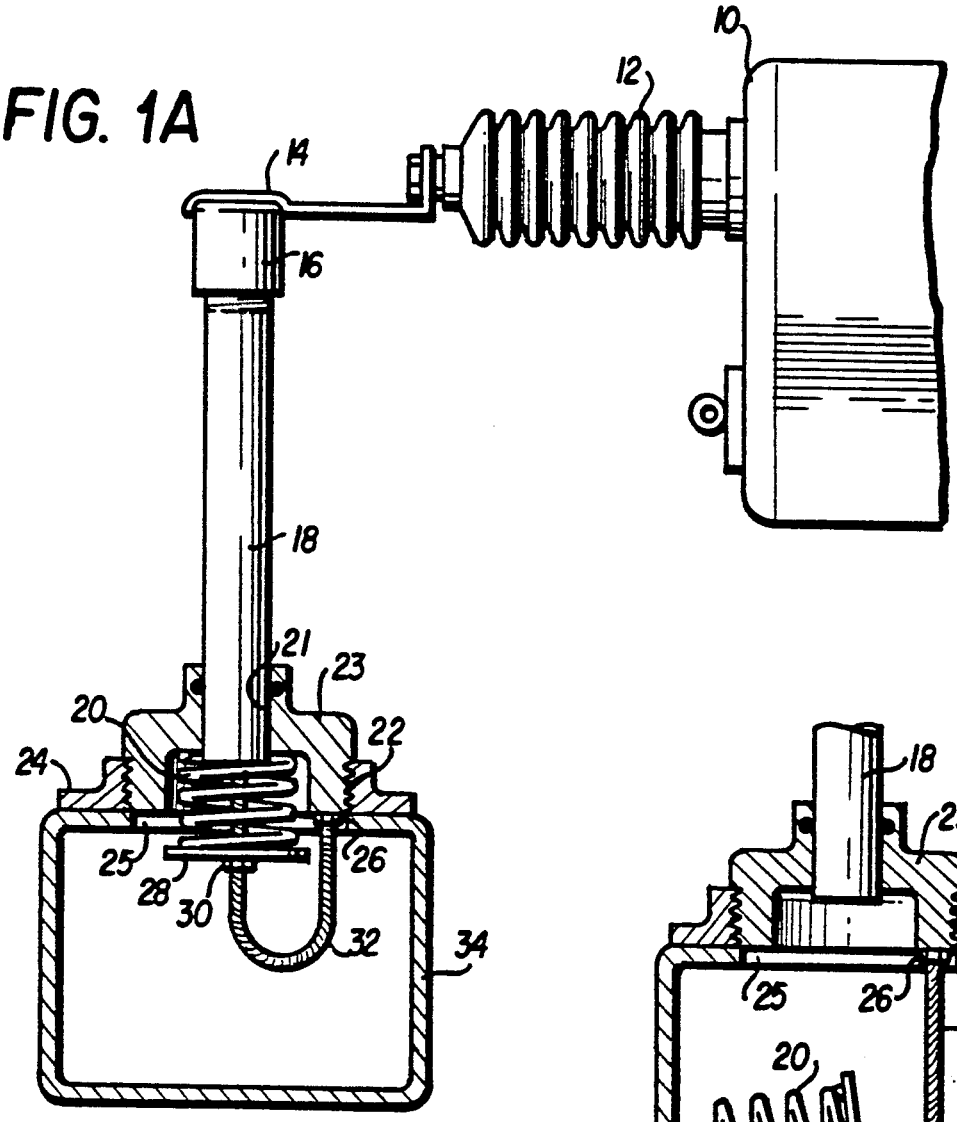
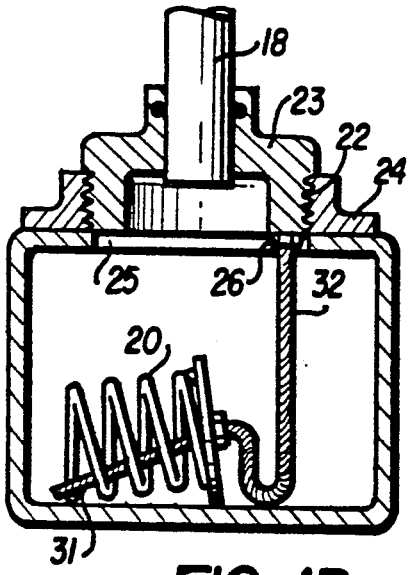
FIG. 1B
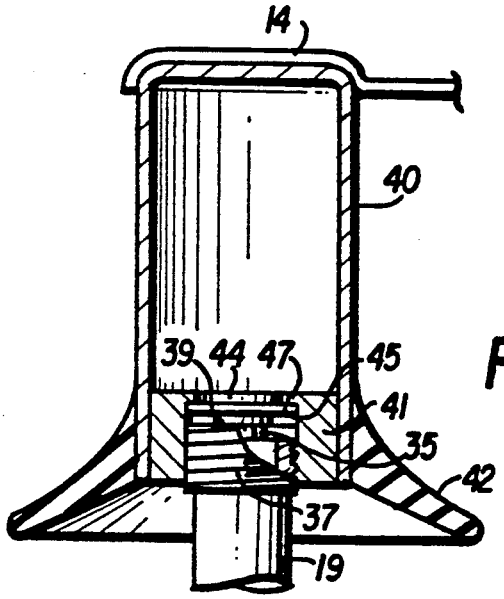
FIG. 2

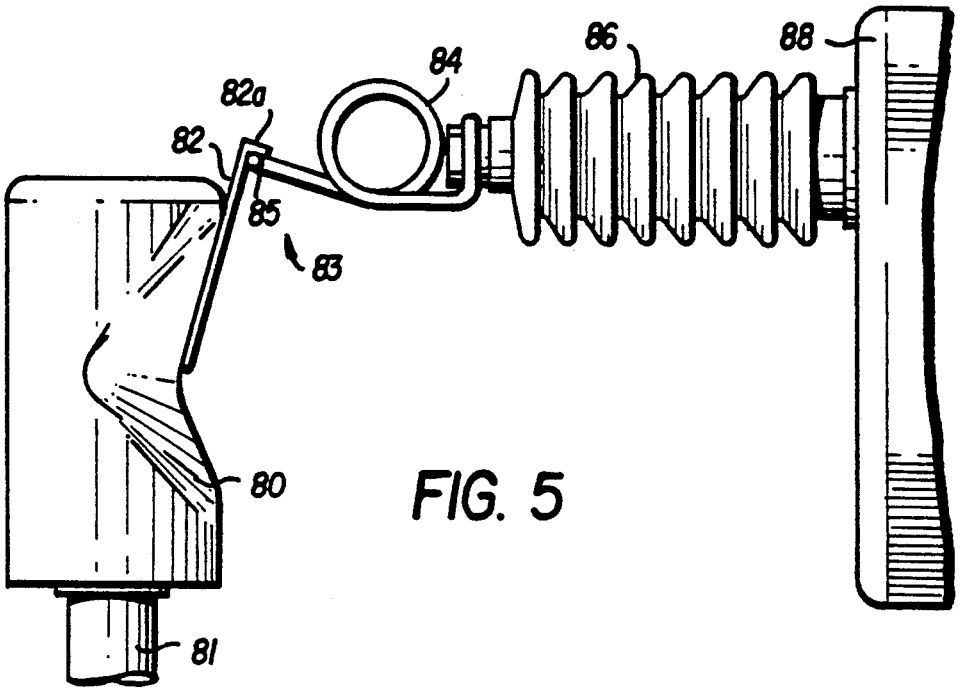
FIG. 5
FIG. 6
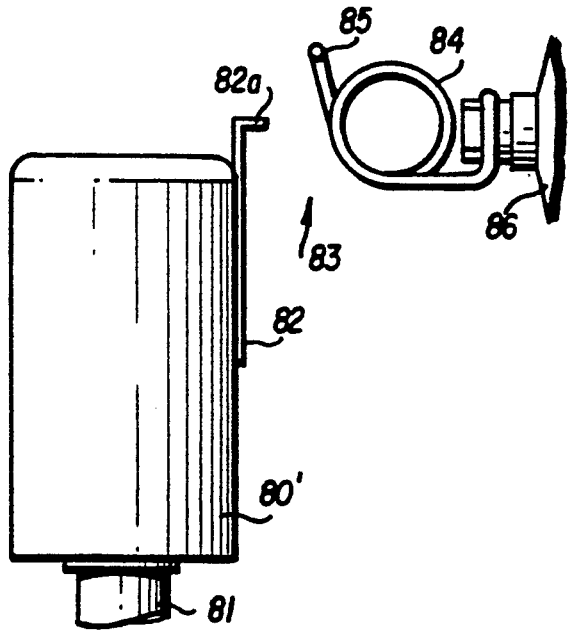
FIG. 9B
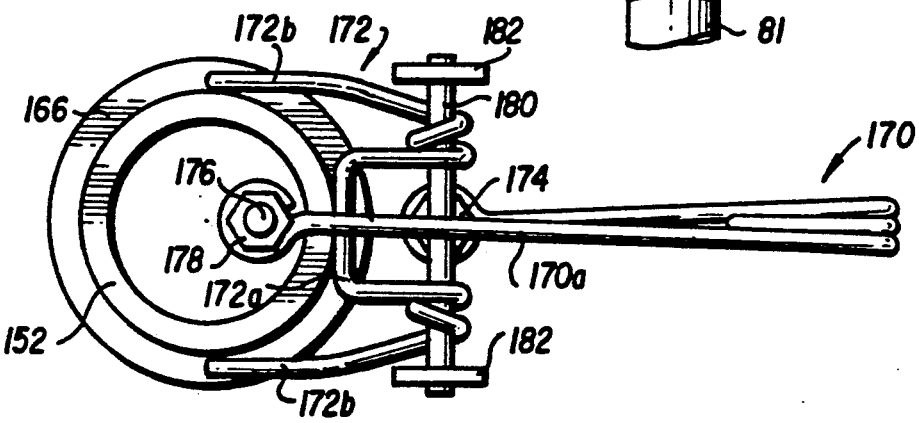

FIG. 7B
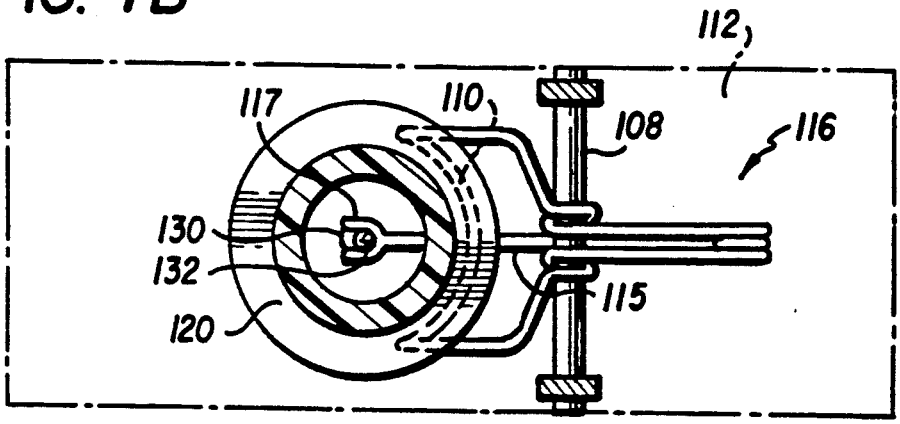
FIG. 10B
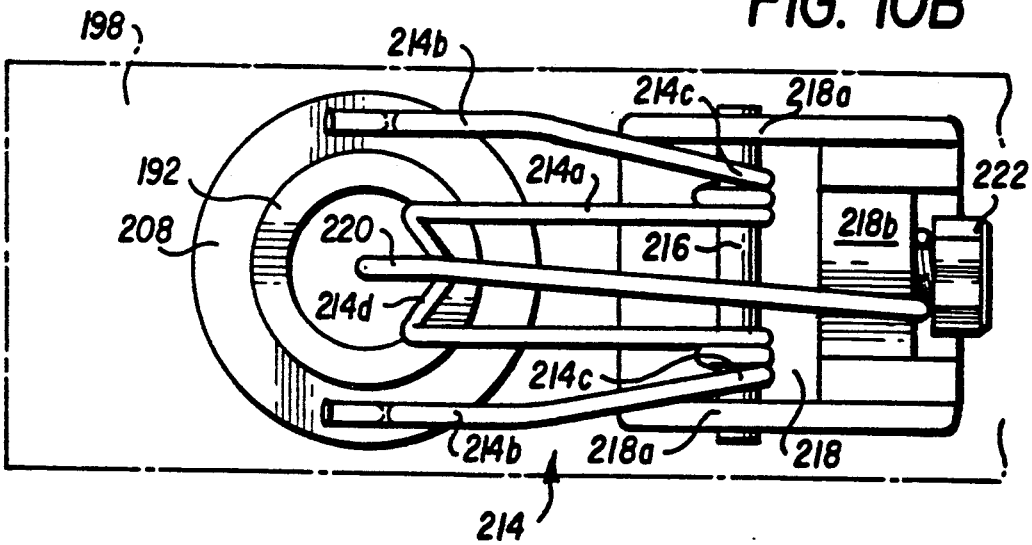
FIG. 12
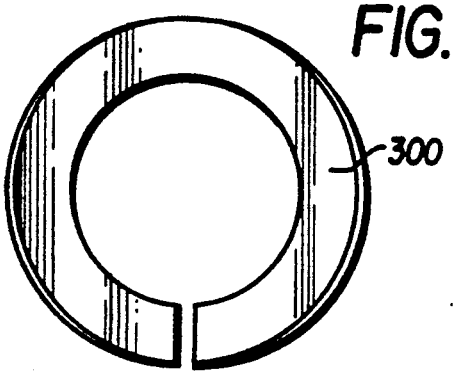
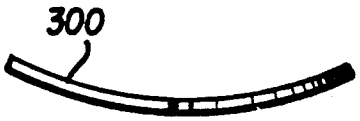
FIG. 13

BUS MOUNTED CAPACITOR EXPULSION-TYPE FUSES

FIELD OF THE INVENTION

The present invention relates to bus mounted capacitor expulsion-type fuses which provide electrical fault protection to power equipment, electrical circuits and devices, and electrical components such as capacitors in the immediate vicinity of the fuse. The present invention provides protection against power surges which might damage the aforementioned power equipment, devices in which it is used, or a plurality of capacitors in the same bank.

DESCRIPTION OF THE PRIOR ART

Expulsion-type fuses provide a reliable, economic method of protecting individual capacitors and large capacitor banks. These fuses emit large volumes of ionized gas during fuse operation that must be directed and controlled such that internal bank flashovers to other capacitors are not initiated. Expulsion fuses are vented fuse protection units having a body part and a fusible part or link and a leader, in which an over-current passing through the fusible element rapidly heats and melts the fusible part. When the fuse "blows", an arc is created. The expulsion of ionized gas produced by this arc rapidly discharges the fusible part (including combustion products) of the fuse connected to the link or leader. This expulsion effect extinguishes the arc. The ionized gas by-product in expulsion fuses is controlled by a muffler or hollow bus according to the prior art. By this arrangement, the fuse link or fuse cap end of the fuse assembly vents into the muffler or hollow bus via an expendable cap arrangement. This is called single-ended venting. The fuse leader or other end of the fuse tube assembly may also vent hot ionized gases during fuse operation. This is called double-ended venting. Single-ended or double-ended venting is thus made possible through use of expulsion-type fuses. See U.S. Pat. No. 4,970,619 which is assigned to the assignee of the present invention. Based on the spacing of the capacitors in the capacitor bank, there is no dielectric flashover problem when proper venting of the ionized gases is accomplished.

High range current-limiting fuses are known in the art as shown in U.S. Pat. Nos. 3,235,688 to Fink et al; 2,827,010 to Cameron et al; 4,011,537 to Jackson, Jr. et al; 4,184,138 to Beard et al; and 4,450,425 to Manning. So are low range current-limiting fuses. See U.S. Pat. Nos. 2,572,901 to Yonkers and 2,917,605 to Fahnoe. Even the combination of such fuses is known. See U.S. Pat. Nos. 3,235,688 to Fink et al and 3,827,010 to Cameron et al. Previously the design of capacitor banks was limited in size when using expulsion fuse protection by the single-ended expulsion fuse rating of 6,000 amperes. With larger capacitor banks that have available fault currents of 10,000 amperes or more, there has developed a need to provide economical and reliable expulsion fuse protection at these higher energy levels. Expensive current limiting fuses can be used on capacitor banks with available fault currents above 6,000 amperes, but are quite costly and not widely accepted.

The prior expulsion fuse art did not satisfy the need to provide protection above 6,000 amperes with single-ended explusion fuse designs. With the use of single-ended fuses large enough to handle 10,000 amperes, capacitor bank bus systems were still found to be damaged. When a capacitor fails in a large bank, its discharge current destroys single-ended expulsion type fuses. The disintegrating fusible link and the hot ionized gases produced at high energy interruptions are blown into adjacent capacitors causing flashovers and resultant damage.

Double-ended explusion type fuses vent the fuse at both ends as noted above. Although double-ended expulsion type fuses are also known in the art, as are fuse link flippers (see U.S. Pat. No. 4,885,561 to Veverka et al) designed to provide a rapid disconnect of a blown fusible leader from its expulsion type fuse, they do not contain in combination a fuse link or leader rapid disconnect mechanism which positively disconnects and ejects the fuse link or leader, combustion products, and hot ionized gases into a hollow bus and/or expansion chamber designed to receive the aforementioned waste products of the fuse.

SUMMARY OF THE INVENTION

The purpose of this invention is to provide for expulsion fuse protection for power equipment, electrical circuits and especially capacitors and capacitor banks. This protection includes the containment of hot ionized gases and other waste products at either or both ends of the fuse assembly. With the proper containment of the hot ionized gases, a variety of more compact capacitor mounting arrangements can be employed, individually failed capacitors can be properly isolated, and blown fuse operation can be readily indicated. The present invention is also designed to protect power capacitor banks in power distribution systems where the discharge of hot ionized gases and metallic materials from the expulsion fuse may damage a number of capacitors in the system.

The present invention further provides for a quick disconnect of a blown fusible link or leader in an expulsion-type fuse and includes an improved fuse link flipper or spring mechanism contained within a hollow bus and/or expansion chamber. The present invention also incorporates a solid cap single-ended vent expulsion fuse mounted on a hollow bus. The solid cap at the top end of the fuse tube is electrically connected in series with a capacitor bank through a high voltage spring connection to the capacitor bushing. The lower part of the fuse tube fits within an aperture or bore of a high voltage hollow bus. An ejection spring is employed within the hollow bus to pull the fuse leader out of the explusion fuse tube into the bus following fuse operation. By this configuration, single-ended venting of hot ionized gases is accomplished into the high voltage hollow bus.

The hollow bus also may advantageously serve as an electrically conductive bus for a bank of fuses electrically connected to a capacitor bank used for power factor correction. Such is shown and described in the aforementioned U.S. Pat. No. 4,970,619 the disclosure of which is incorporated herein by reference. The hollow bus serves as a manifold to receive the expulsion discharge products and safely contain and divert them without damaging adjacent capacitors, fuses or other equipment. The manifold safely diverts these discharge products from any personnel in the immediate vicinity when the fuse blows.

In an alternate embodiment, the present invention incorporates a cylindrical expansion chamber with an internal expendable fuse cap added to the upper end of the fuse tube. The addition of the expansion chamber allows for a substantial increase in power frequency interruption and high frequency capacitor bank discharge energy capability of the fuse. Fuse protection is thus provided to handle 10,000 amperes or more. The expansion chamber will generally contain enough volume to reduce the peak pressure during power frequency interruption such that the fuse tube is not damaged. The expansion chamber also provides a secondary source of cool de-ionized gases to combine with and render inoccuous the hot ionized gases.

A still further embodiment of the invention incorporates a weather shed added to the cylindrical expansion chamber to decrease the dielectric stress on the fuse tube following power frequency interruption. A variation of this embodiment includes a non-conductive, i.e., insulating, chamber and integral weather shed.

In a further modification, the cylindrical expansion chamber can be deformed and attached to an upper end current interchange. When the fuse operates at power interruptions of 3,000 amperes or more, the expendable cap will "blow" and the increase in pressure will expand the deformed expansion chamber and return it to its cylindrical shape to thereby release a spring used as a current interchange with the capacitor bank. This results in the removal of dielectric stress from the fuse tube. For fuse operations at 3,000 amperes or less, the upper fuse spring current interchange will not disconnect and thus will not indicate fuse operation.

In a further embodiment of the invention, a coaxial coil spring fuse leader quick release is replaced by a fuse flipper and fuse tube latch spring in the hollow bus. In this embodiment, the fuse tube is not bolted to the hollow bus, but is held in a closed position to a fuse mounting plate. The flipper spring, by virtue of its pivot point and mechanical advantage on the latch, pushes on the shoulder of the fuse collar to hold the fuse tube in a closed position. The other end of the fuse flipper spring is held in place with the fuse leader under tension by a fuse leader crimp-stop. Once the fuse link has been loaded in the fuse tube with spring flipper and the expendable cap and expansion chamber are in place, the assembly is placed in an aperture slot or bore in the hollow bus. The fuse mounting plate is tightened down with nuts to provide an electrical connection between bus and fuse mounting plate assembly.

A further embodiment of the invention incorporates an independent latch spring to axially support the fuse tube assembly. The fuse flipper can also be mounted on an assembly mounting plate. Once the fuse is "blown," a retractor spring plus gravity will work to retract the fuse tube into the hollow bus. The retraction of the fuse tube opens an isolating air gap between the top of the fuse assembly expansion chamber and its contact connection with the capacitor. Furthermore, plastic bearing seals or split collar gas seals can be used with the mounting plate so that the fuse tube assembly as installed in the mounting plate fuse hole provides a snug fit. The seals will allow fuse tube retraction as necessary, but will still provide enough of a seal/baffle to prevent most hot ionized gases from flowing out of the retracted fuse tube body or hollow bus.

A further design incorporates a retractable fuse tube. In this case an axially oriented coil spring which is retained to the fuse assembly mounting plate is compressed at the time of fusing. Compression is maintained by means of a retention bar. The retention bar contacts the fuse tube collar by means of spring arms that provide an upwardly directed force to hold the fuse tube in place in the mounting plate.

Among the objects of this invention is to provide an improved expulsion-type fuse which is useful with large capacitor banks with power fault current availability up to at least 10,000 amperes.

A further object of this invention is to limit or control expulsion fuse exhaust gases and discharge materials from coming into contact with adjacent capacitors or other materials which can be damaged by the discharge products and fuse forces.

A still further object of this invention is to limit open fault arcing to adjacent capacitors and lines and from harming personnel or wildlife in the vicinity of the bus mounted capacitor fuse.

Another object of this invention is to provide an improved single or double-ended venting expulsion-type fuse.

Also, it is an object of this invention to provide a connection of one or more fuses to an electrically conductive manifold capable of serving as a bus wherein discharge gases emitted from the expulsion fuse are directed through the wall of the electrically conductive bus when the fuse is blown.

Furthermore, it is an object of this invention to provide an expendable cap located on the end of the fuse which can safely "blow," along with other waste products, into an expansion chamber, thus protecting adjacent capacitors.

A further object of this invention is to provide for expanded use of a double-ended venting expulsion fuse with safe operation as required by capacitor banks having large magnitude high frequency discharge currents and high available fault currents for major power system feeders.

Finally, it is an object of this invention to provide safe electrical fault protection to power equipment, electrical circuits and devices, and electrical elements with the use of a hollow bus and/or expansion chamber together with a mechanism by which to securely mount a fuse tube into said bus and/or chamber.

BRIEF DESCRIPTION OF THE DRAWINGS

The above and further objects, features and advantages of the present invention will become apparent to those skilled in the art from a consideration of the following detailed description of the preferred embodiment, taken in conjunction with the accompanying drawings in which:

FIG. 1A is a side elevation view, partly in section, of an expulsion-type fuse mounted into a hollow bus according to the present invention;

FIG. 1B is a partial cross sectional view illustrating the result of the activation of the fuse depicted in FIG. 1A;

FIG. 2 is a partial cross-sectional view illustrating an expansion chamber configured with a weather shed for mounting on the external end of an expulsion fuse;

FIG. 5 is a fragmentary side elevation view illustrating an embodiment of a deformed expansion chamber connected to the external end of an expulsion fuse on one end and a capacitor bushing contact spring on the other end;

FIG. 6 is a fragmentary side view showing the fuse of FIG. 5 following fuse operation and restoration of the expansion chamber to its undeformed state;

FIG. 7B is a cross-sectional view taken along line 7B—7B in FIG. 7A showing the configuration of the tube latch spring of FIG. 7A;

FIG. 9B is a bottom view of the latch spring of FIG. 9A as viewed from line 9B—9B in FIG. 9A;

FIG. 10B is a cross-sectional view taken along line 10B—10B in FIG. 10A showing the configuration of the fuse flipper and support spring of FIG. 10A;

FIGS. 12 and 13 are top and side views respectively showing the fuse retractor spring used to retract the fuse into the hollow bus in the embodiments of FIGS. 10A and 11.

DETAILED DESCRIPTION OF THE PREFERRED EMBODIMENTS

Figure 3:
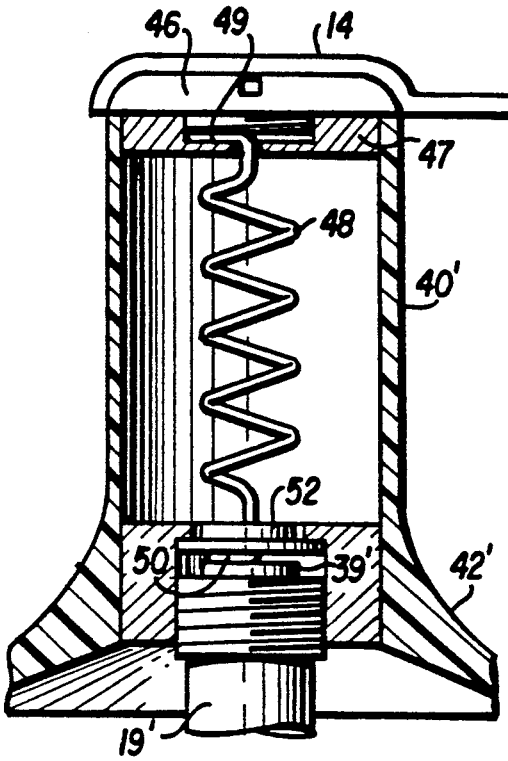
FIG. 3 is a partial cross-sectional view of a hollow bus mounted capacitor fuse with an insulating weather shed mounted on an external end of an expansion chamber.

Referring now to the drawings, the various embodiments of the present invention are illustrated in FIGS. 1—13. FIG. 1A shows a cross-section of a solid cap single-ended vent expulsion fuse mounted on a high voltage hollow bus. In the right-most portion of FIG. 1A there is shown a capacitor tank 10 which contains a capacitor used in a power distribution system. The capacitor in tank 10 has a high voltage bushing 12, at the left end of which is a connection to a contact spring 14. The spring 14 is fitted over and electrically connects a metal fuse cap 16 which is threadably connected to the upper end of fuse tube 18. The lower end of the fuse tube 18 is mounted in a bore 21 of a fuse base mounting plate 23 which is threadably secured at 22 to a mounting flange 24. Mounting flange 24 is mechanically and electrically connected to a hollow high voltage bus 34 generally of the type described in the aforementioned U.S. Pat. No. 4,970,619.

At the lower end of fuse tube 18 is shown a fuse leader 32 which forms a portion of a fusible part extending through fuse tube 18. The fuse leader 32 extends through the fuse base 23 and flange 24 and through an aperture 25 in hollow bus 34 and is electrically connected to the bus 34 via electrical connection 26, base 23 and flange 24.

Tension is applied to the fuse leader 32 by a fuse leader ejection spring 20 which is maintained under compression by a spring tension plate 28 and retainer 30 crimped onto the fuse leader 32 at an appropriate location. Other suitable arrangements for maintaining the spring 20 under compression will be apparent to those skilled in the art.

Ejection spring 20 aids in rapidly ejecting or pulling the fuse leader out of expulsion fuse tube 18 during fuse operation. The single-ended venting of ionized gases from the lower end of fuse tube 18 is accomplished in hollow bus 34. In this arrangement, the fiber fuse tube 18 remains connected in series with the failed or partially failed capacitor in capacitor tank 10 after fuse operation.

FIG. 1B shows the condition of the expulsion fuse of FIG. 1A after fuse operation. Fuse leader 32 is shown detached from the fusible part in fuse tube 18 because of melting and separation of the fusible part as at 31. Ejection spring 20 is shown uncompressed and lying in the lower portion of bus 34 due to the fuse operation. The fuse arrangement may be replaced by unthreading the base 23 from the flange 24 at threaded connection 22 and threading a new fuse arrangement in place.

FIG. 2 illustrates an arrangement for use with a double-ended vent expulsion fuse 19 that may be used between a bus mounting identical to that shown in FIG. 1A and the contact spring 14 also shown in FIG. 1A. In FIG. 2 a cylindrical metal expansion chamber 40 replaces the solid cap 16 of the fuse 18 of FIG. 1A. Expansion chamber 40 is threadably mounted to an externally threaded metal sleeve 37 mounted on the upper end of fuse tube 19 by an internally threaded metal sleeve 41 which is welded, brazed or otherwise mechanically and electrically connected to the expansion chamber 40. The upper end of the fusible link (not shown) in fuse tube 19 is formed with a conductive disk or fusible link head 39 retained on an inwardly projecting annular lip 35 of sleeve 37.

An expendable cap 44 made of a frangible material has an annular flange 45 which engages upwardly against an annular shoulder 47 on sleeve 37. Cap 44 is retained in place by compression between the annular lip 35, fusible link head 39, annular flange 45 and shoulder 47 when the threaded connection between the metal sleeves 37 and 41 is made. When the fuse blows, the gas pressure in fuse tube 19 fractures cap 44 allowing the venting of the gases from the upper end of the fuse tube 19.

The addition of expansion chamber 40 and expendable cap 44 allows for a substantial increase in power frequency interruption, e.g. current protection, and the high frequency capacitor bank discharge energy capability of the fuse. Although the gas expansion chamber 40 as shown is not vented to the outside atmosphere, it preferably contains enough volume to reduce the peak pressure during fuse interruption such that fuse tube 19 is not damaged. For extremely high energy levels (currents), expansion chamber 40 can be modified to provide a secondary release of cooled de-ionized gases to prevent damage to the capacitor bank from the hot ionized gases. If desired, an insulating weather shed 42 may be added to the expansion chamber 40 as by bonding, for example, to decrease the dielectric stress on fuse tube 19 following power interruption.

FIG. 3 shows a modification of the bus mounting and double-ended venting shown in FIG. 2. In FIG. 3, a non-conductive expansion chamber 40' is mounted onto fuse tube 19' in the same manner as chamber 40 is mounted to fuse tube 19 as shown and described in connection with FIG. 2. In order to make the electrical connection, the contact spring 14 contacts screw plug 46 which is threaded into a bore in a metal plate 47 attached to the end of expansion chamber 40'. The upper free end 49 of a tension spring conductor 48 is clamped between the threaded end of screw plug 46 and plate 47 to form a mechanical and electrical connection therebetween. The lower free end 50 of spring 48 passes through expendable cap 52 and is clamped between the cap 52 and the head 39 of the fusible link (not shown). As shown in FIG. 3, spring 48 is in a stretched condition between plate 47 and cap 52. There is thus an electrical connection between the capacitor and the fusible link. Weather shed 42' is formed integrally with the insulating expansion chamber 40'.

Figure 4:
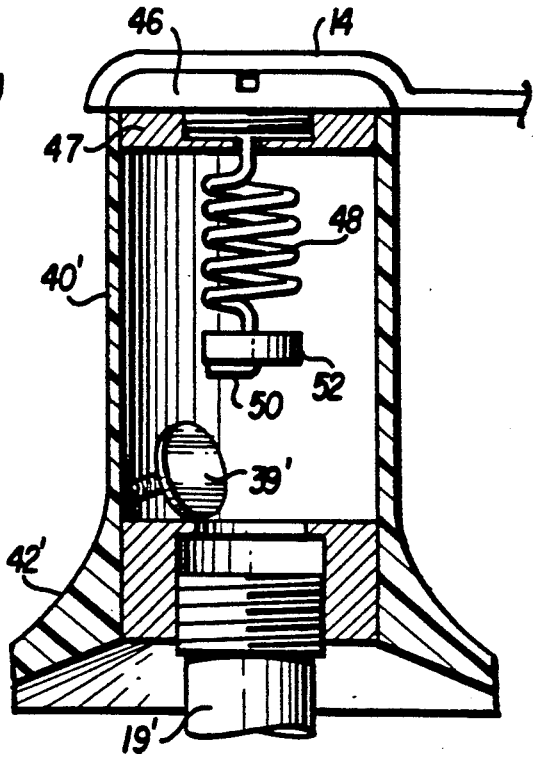
FIG. 4 is a cross-sectional view showing the fuse of FIG. 3 following fuse operation.

FIG. 4 shows the bus mounting fuse assembly of FIG. 3 following fuse operation. When the fuse operates or "blows", the tension in spring 48 and the gases generated by fuse operation eject the expendable cap 52 from fuse tube 19'. Hot ionized gases and other waste products discharged from the upper end of tube 19' expel the head 39' of the fusible link into the insulating expansion chamber 40'. Such gases and waste products as are discharged from the lower end of tube 19' are contained within a hollow bus such as bus 34 shown in FIGS. 1A and 1B.

FIG. 5 shows a further modification of an expansion chamber 80 fitted on top of a fuse tube 81. The chamber 80 may be mechanically and electrically attached to the fuse leader in tube 81 in the same manner as chamber 40 is connected to the fuse leader in tube 19 described above in connection with FIG. 2. Thus, double-ended venting is possible with the arrangement of FIG. 5. Expansion chamber 80 is a preset deformed cylindrical metal expansion chamber to which is attached at its right-most side an upper end current interchange 83. Forming interchange 83 is an L-shaped conductive bracket 82 which is brazed, welded or otherwise electrically and mechanically affixed into the deformed portion of expansion chamber 80. The free end 85 of a conductive spring 84 is mechanically and electrically engaged with L-shaped bracket 82. Spring 84 is attached to high voltage bushing 86, which in turn is attached to capacitor tank 88. The free end 85 of spring 84 is rotated counterclockwise as seen in FIG. 5 and is engaged beneath the short leg **82*a* of L-shaped bracket 82 and is held in place by the torsion of spring 84**.

When the fuse operates for power interruptions of 1,000 amperes or more, the fuse will "blow" and the increase in pressure in chamber 80 will expand the deformed wall of expansion chamber 80 to the cylindrically shaped chamber 80' shown in FIG. 6. This operation open circuits the upper spring current interchange 83 by rotating the leg **82*a* of bracket 82 counterclockwise, thereby releasing the free end 85 of spring 84 and permitting the same to torsionally rotate clockwise to the position shown in FIG. 6. This will remove the dielectric stress from fuse tube 81 and provide a visual indication of fuse operation. Thus, in FIG. 6, the force from the ionized gases in chamber 80 has disengaged the L-shaped bracket 82 from spring 84, shown in its neutral or untorsioned condition, indicating that fuse operation at 1,000 amperes or more has occurred. For fuse operations at 1,000 amperes or less, the upper fuse spring current interchange 83 will not disconnect and thus single-vent fuse operation will not be indicated. Under this condition, there are no hot ionized gases discharged in chamber 80 to straighten the deformed wall of the chamber 80 and release the connection between spring 84 and bracket 82**.

Figure 7A:
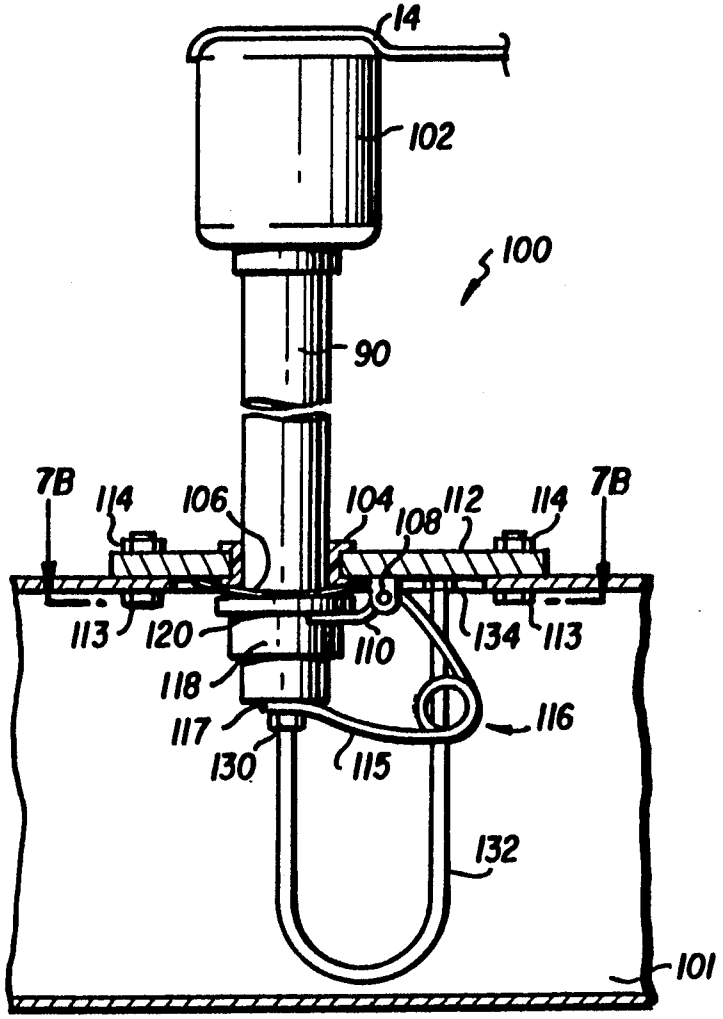
FIG. 7A is a side elevation view, partly in cross section, of a variation of the bus mounted capacitor fuse invention with a flipper and tube latch spring.

FIG. 7A shows another embodiment of a fuse assembly 100 according to the invention having the basic functional fuse operational features of FIGS. 1A and 2 with double-ended venting. In FIG. 7A, however, the fuse leader ejection spring 20 has been replaced by a fuse flipper and tube latch spring 116 which operates in the following manner. Fuse tube 90 is slidably received in a low friction seal bushing 104 mounted in a throughbore in mounting plate 112. Mounting plate 112 is secured to one side of hollow bus 101 by means of bolts 113 and nuts 114. Fuse tube 90 is provided at its lower end with a collar 118 having an annular shoulder 120. Fuse tube 90 is held in its uppermost position relative to bus 101 by means of flipper and latch spring 116.

Referring to FIGS. 7A and 7B it will be seen that spring 116, which is formed of a bent wire or rod, is pivotally mounted to the underside of mounting plate 112 by means of a pivot shaft 108. An upper U-shaped latch portion 110 of the spring engages under the annular shoulder 120 of fuse collar 118 such that when the spring 116 is forced clockwise about pivot shaft 110, the portion 110 urges the fuse tube upwardly toward the mounting plate against the resilient bias of a pair of leaf springs 106 which may be secured to the upper collar 118 on oppsite sides of the fuse tube 90. The lower portion 115 of spring 116 has a bifurcated end 117 which, when flexed upwardly is engageable with a stop lug or nut 130 crimped onto the fuse leader 132 extending out of fuse tube 90. The torsion in spring 116 simultaneously applies a downwardly directed tensile force to fuse leader 132 and an upwardly directed tensile to the shoulder 120 of collar 118 to hold the fuse in its position in bus 101 as shown in FIG. 7A. Fuse leader 132 is electrically and mechanically connected to mounting plate 112 by means of fitting 134.

It will be appreciated that the entire fuse assembly 100 mounted on mounting plate 112 may be installed in an opening provided in bus 101 and secured in place with bolts 113 and nuts 114. Thus, when a fuse blows, it can be readily replaced by removing the entire fuse assembly 100, including its mounting plate 112, and replacing it with a new fuse assembly.

At its upper end, the fuse tube 90 is provided with an expansion chamber 102 which could be of the type described above and shown in FIGS. 2–4. Electrical connection to a capacitor bank may be made with the spring contact connection 14 which functions in the same manner as spring 14 of FIGS. 2–4.

Figure 8:
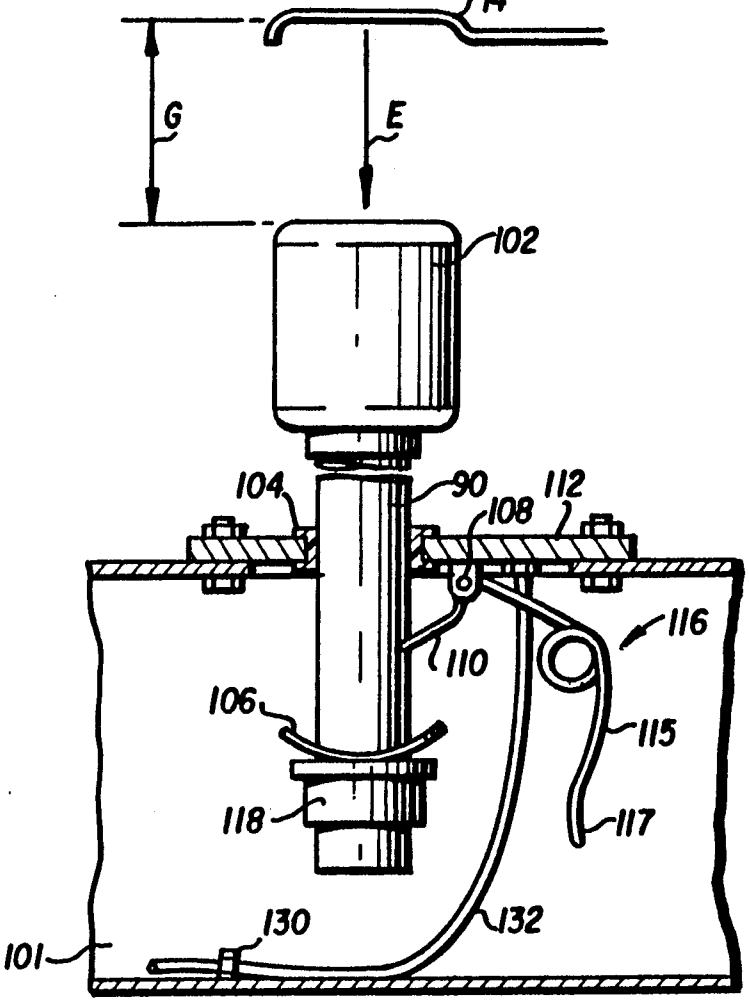
FIG. 8 is a side elevation view, partly in section, showing the fuse of FIGS. 7A and 7B following fuse operation.

Referring now to FIG. 8, the operation of the fuse assembly 100 will be described. When the fuse "blows," it will vent from the lower end or from both ends of the fuse tube 90. As the fusible part (not shown) inside the fuse tube 90 melts, the tensile force applied by the spring 116 on the fuse leader 132 will rapidly pull the fuse leader 132 from the tube 90 to aid in extinguishing the arc. Hot ionized gases created by the arc in the tube are expelled into hollow bus 101. Substantially simultaneously with the pulling of the fuse leader 132 from the tube 90, the upper latch portion 110 of the spring 116 swings counterclockwise about pivot shaft 108 releasing the upward force holding the fuse assembly 100 upwardly. The fuse tube 90 and chamber 102 will be urged downwardly by leaf springs 106 as shown by the arrow E and open a large isolation gap G between the chamber 102 and the spring contact 14 thereby removing the dielectric stress on the tube 90 which would otherwise have the high voltage impressed across it.

Advantageously, the embodiment of FIGS. 7A, 7B and 8 also provides a visual indication of a blown fuse since the fuse assembly 100 will be at a lower height relative to other fuses in the hollow bus 101 and a gap G will exist between the chamber 102 and spring contact 14.

If desired, the leaf spring 106 may be formed as a washer-like element secured to the underside of mounting plate 112. In that form, the spring will serve in its compressed position as a baffle to prevent hot ionized gases from blowing up between the fuse tube 90 and the seal bushing 104.

Figure 9A:
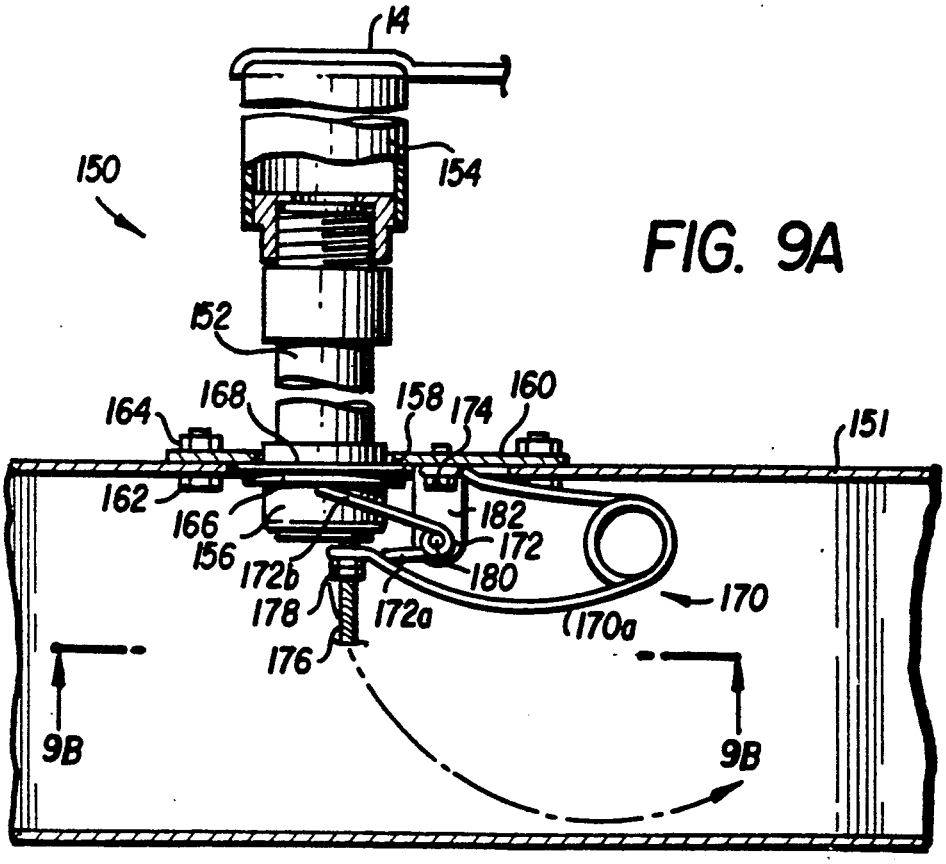
FIG. 9A shows in cross-section a bus mounted capacitor fuse with a latch spring and separate flipper spring.

FIGS. 9A and 9B illustrate in cross section an alternative embodiment of a double-ended venting fuse assembly 150 mounted on a hollow bus 151 similar to the fuse assembly 100 of FIGS. 7A, 7B and 8, the primary difference being in the configuration of the fuse latch and flipper spring. Fuse assembly 150 comprises a fuse tube 152 with an expansion chamber 154 which may have the same construction as the expansion chambers 40 and 102 of FIGS. 2 and 7A, respectively. The lower end of the fuse tube 152 is provided with a collar 156 which is mounted in an opening 158 in mounting plate 160 secured over a slot or opening in hollow bus 151 by bolts 162 and nuts 164. Collar 156 has an annular lip 166 with a diameter larger than the diameter of opening 158 so that when urged upwardly, the lip 166 abuts against the underside of mounting plate 160. A washer-like leaf spring 168 is disposed between the lip 166 and the mounting plate 160 and forms a temporary seal therebetween to contain the hot gases discharged into the bus 151 when the fuse blows.

In the embodiment of FIGS. 9A and 9B, the fuse latch and flipper spring comprises two separate but cooperating elements, namely, a flipper spring 170 and a fuse latch spring 172. Flipper spring 170 is secured at one end to the underside of mounting plate 160 by a bolt 174. The other end of spring 170 is rotated clockwise to place the spring under torsion and is secured to the fuse leader 176 by means of a stop lug or nut 178 secured or crimped to the fuse leader in a manner similar to that shown in FIG. 7A. Fuse latch spring 172 is pivotally arranged on a pivot shaft 180 supported on a pair of plates 182 extending downwardly from mounting plate 160. Spring 172 has a U-shaped portion **172*a* that is engaged and urged upwardly or clockwise by the lower leg 170*a* of spring 170. As a consequence, the upper leg portions 172*b* of spring 172 engage the lip 166 of the fuse collar 156 and urge the fuse upwardly against the bias of leaf spring 168 to its uppermost position with the chamber 154 in electrical and mechanical contact with the high voltage spring contact 14 as shown in FIG. 9A. The fuse leader 176 may be electrically connected to the bus 151 at any convenient location, preferably to the mounting plate 160** by means of a bolt (not shown).

When the fuse blows, the fuse leader 176 will be rapidly pulled from the fuse tube 152 by the torsioned spring 170 and the hot ionized gases will vent into the hollow bus 151 (single-vent) and possibly also into the chamber 154 (double-vent). The lower leg portion **170*a* of the spring 170 swings counterclockwise as shown by the arrow and disengages from the U-shaped portion 172*a* of latch spring 172. This permits latch spring 172 to rotate counterclockwise about pivot shaft 180 thereby releasing the upward force that leg portions 172*b* exert on the annular lip 166 of fuse collar 156. The fuse is then free to drop downwardly into the hollow bus 151 providing an isolation gap between the chamber 154 and spring contact 14** and providing a visual indication of fuse operation.

Figure 11:
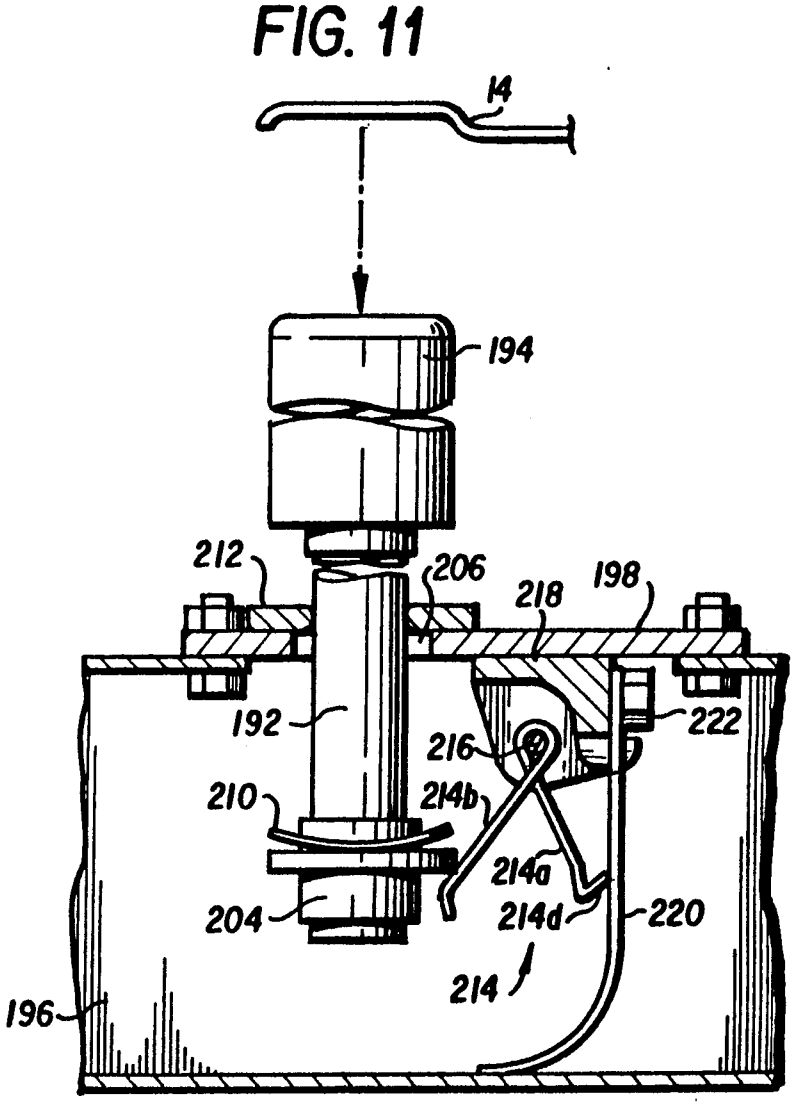
FIG. 11 is a side elevation view in cross-section showing the fuse of FIGS. 10A and 10B following fuse operation.
Figure 10A:
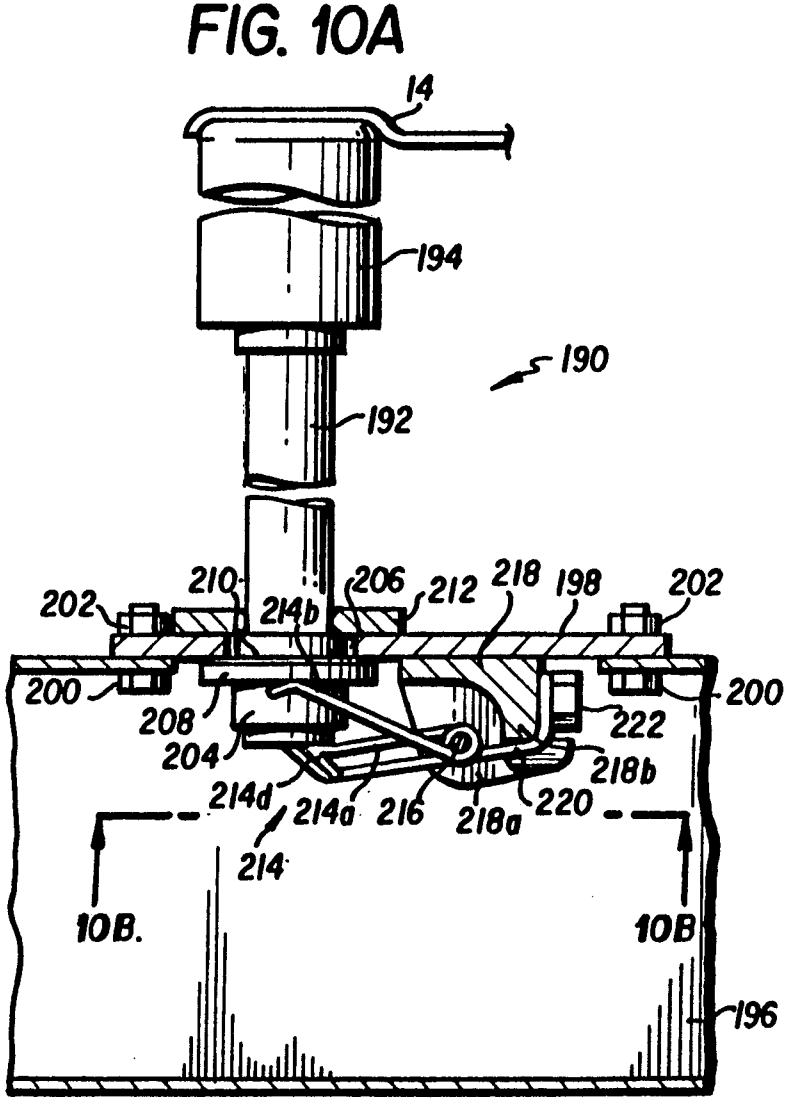
FIG. 10A is a side elevation view, partly in section, showing an alternate embodiment of the fuse flipper and fuse support spring according to the invention.

Another embodiment of a fuse flipper and fuse latch spring is shown in FIGS. 10A, 10B, and 11. Referring first to FIGS. 10A and 10B, the fuse assembly 190 comprises a fuse tube 192 with an expansion chamber 194 secured to the upper end thereof. Chamber 194 is made of a conductive material and electrically contacts spring 14 as in the previously described embodiments. The fuse assembly 190 is connected to a hollow bus 196 by means of a mounting plate 198 which is attached over an opening in the wall of bus 196 by bolts 200 and nuts 202. A fuse collar 204 is secured to the lower end of fuse tube 192 which passes through an opening 206 in mounting plate 198. Fuse collar 204 has an annular lip 208 which bears upwardly on the underside of mounting plate 198 with a washer-like leaf spring 210 interposed therebetween. A split collar gas seal 212 is positioned about the fuse tube 192 on the upper side of mounting plate 198 and forms a sliding seal with the outside diameter of fuse tube 192. The ring-shaped split collar gas seal 212 is attached to the mounting plate after the fuse tube 192 is installed in the opening 206 of mounting plate 198. The gas seal will provide a sufficient clearance around the fuse tube 192 to allow tube retraction. It will, however, provide enough of a seal/baffle to prevent most hot ionized gases from flowing past the fuse tube during fuse operation.

A fuse flipper and latch spring 214 is pivotably mounted on a pivot shaft 216 supported on a contact block 218 welded or otherwise mechanically and electrically affixed to mounting plate 198.

As best seen in FIG. 10B, pivot shaft 216 is supported at its ends in a pair of depending side plates **218*a* of contact block 218. Fuse flipper and latch spring 214 is made of a single rod or wire bent to form a flipper loop portion 214*a* and a pair of latching legs 214*b* connected to one another by a pair of torsional spring coils 214*c* through which pivot shaft 216 extends. Loop portion 214*a* includes a bent end portion 214*d* which is engagable with a fuse leader 220 extending from fuse tube 192. The free end of fuse leader 220 is pulled beneath pivot shaft 216, around an abutment 218*b* of contact block 218 and is electrically and mechanically secured to block 218 by means of a bolt 222 to provide a current path between spring contact 14 and hollow bus 196**.

It will be understood that to set or latch the fuse assembly 190 in position as shown in FIGS. 10A and 10B, the spring 214 is pivoted clockwise about shaft 216 until the legs **214*b* bear upwardly against annular lip 208 and leaf spring 210 is compressed against mounting plate 198. Fuse leader 220 is then drawn to the right beneath the bent end portion 214*d* of loop portion 214*a*, under pivot shaft 216, across abutment 218*b* and is wrapped about the shaft of bolt 222 in its loosened condition. Tension is then applied to the fuse leader 220 to urge loop portion 214*a* clockwise about shaft 216 and into engagement with the lower end of fuse tube 192. Bolt 222 is then tightened against the fuse leader 220 to restrain the same in its tensioned condition. Forcing loop portion 214*a* clockwise also urges the leg portions 214*b* clockwise creating torsion in coils 214*c* and thereby applying an upwardly directed force on the lip 208 to hold the fuse assembly 190 in its uppermost position as shown in FIG. 10A**.

Operation of the fuse shown in FIG. 11. When the fuse blows by melting the fusible link in fuse tube 192, fuse leader 220 will be rapidly pulled from the tube 192 by the torsioned loop portion **214*a* of spring 214 to aid in extinguishing the arc. Hot gases will discharge into hollow bus 196 and the spring 214 will pivot counterclockwise about shaft 216 to disengage the legs 214*b* from lip 208. Gravity and the force of compressed leaf spring 210 urges the fuse tube 192 downwardly to disengage the expansion chamber 194 from the high voltage contact spring 14 and create an isolation gap therebetween reducing the dielectric stress on the fuse tube 192 and providing a visual indication of fuse operation. As in previously described embodiments, the expansion chamber 194** provides double venting in the case of very high fault currents, e.g., in excess of 1,000 amperes.

The fuse flipper and latch spring 214 may also be constructed with loop portion 214*a* formed as a rigid lever pivotable about pivot shaft 216 with a coil spring arranged on the shaft 216 to apply a counterclockwise torque to the lever. The latch legs 214*b* may comprise one or a pair of leaf springs secured to the rigid lever and arranged to urge the fuse tube upwardly. Other equivalent configurations of the fuse flipper and latch spring will occur to those skilled in the art in light of the teachings herein.

FIGS. 12 and 13 illustrate one form of the springs that are used to retract the fuse tube into the hollow bus in the embodiments of FIGS. 7A, 9A and 10A. The spring 300 comprises a split, washer-like ring in which the planer surface of the ring has been formed into a segment of a cylindrical surface.

As used in the specification and claims herein, the term "torsional spring" refers to the bent wire spring shown in FIGS. 5, 6, 7A, 7B, 9A, 9B, 10A and 10B.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A fault protection device for use in protecting a plurality of electrical circuits comprising:

a hollow, electrically conductive bus;

a plurality of fuse means for electrically connecting said hollow bus to a respective one of the electrical circuits, each of said fuse means comprising a fusible link; and a plurality of means in said hollow bus, each associated with a respective one of said plurality of fuse means, for pulling at least a portion of the fusible link of each of said fuse means which blows into said hollow bus.

2. A fault protection device according to claim 1, wherein at least one of said fuse means is an expulsion-type fuse, the pulling means associated therewith being connected to the fusible link of said one fuse means to rapidly withdraw the fusible link from said one fuse means, whereby hot gases discharged from said one fuse means when said one fuse means blows are discharged into the hollow bus.

3. A fault protection device according to claim 1, wherein at least one of said pulling means is a spring.

4. A fault protection device for use in protecting an electrical circuit comprising:

a hollow bus;

fuse means for electrically connecting said hollow bus to the electrical circuit, said fuse means comprising a fusible link, said fuse means comprising a double-vent expulsion-type fuse having a fuse tube, one end of said fuse tube extending into said hollow bus, and an expansion chamber mounted to the other end of the fuse tube, whereby hot gases discharged from the fuse tube when the fuse means blows are discharged into the hollow bus or into said hollow bus and said expansion chamber; and means in said hollow bus for pulling at least a portion of said fusible link into said hollow bus when said fuse means blows.

5. A fault protection device according to claim 1, including a fuse leader connected to said fusible link of at least one of said fuse means, the pulling means associated with said one fush means comprising spring means operatively connected to said fuse leader for applying a tensile force thereto such that when said one fuse means blows, the fusible link thereof is separated to rapidly extinguish the arc resulting from the blown fuse means.

6. A fault protection device for use in protecting an electrical circuit comprising:

a hollow bus;

fuse means for electrically connecting said hollow bus to the electrical circuit, said fuse means comprising a fusible link;

a fuse leader connected to said fusible link;

means in said hollow bus for pulling at least a portion of said fusible link into said hollow bus when said fuse means blows, said pulling means comprising spring means operatively connected to said fuse leader for applying a tensile force thereto such that when the fuse means blows, the fusible link is separated to rapidly extinguish the arc resulting from the blown fuse means, said spring means comprising one of a coil spring and a torsional spring.

7. A fault protection device according to claim 5, including means for removably mounting said one fuse means to the hollow bus, said fuse leader being electrically and mechanically connected to said mounting means and said mounting means being electrically and mechanically connected to said hollow bus.

8. A fault protection device according to claim 4, wherein said expansion chamber is conductive and is electrically connected to the fusible link, and including high voltage spring contact means for electrically connecting the fusible link to the electrical circuit through said expansion chamber.

9. A fault protection device according to claim 4, including high voltage spring contact means for electrically connecting the fusible link to the electrical circuit, said expansion chamber being non-conductive and means passing through the expansion chamber for electrically connecting the fusible link to the high voltage spring contact means.

10. A fault protection device according to claim 9, wherein said means for electrically connecting the fusible link to the contact means comprises a stretched coil spring having two ends, conductive screw means threaded into the said expansion chamber for electrically connecting the contact means to one end of the coil spring, the other end of the coil spring being electrically connected to the fusible link such that when the fuse means blows, the stretched coil spring will pull away from the fusible link and will return to its unstretched length.

11. A fault protection device according to claim 4, including a weather shed mounted exteriorily of said expansion chamber.

12. A fault protection device according to claim 4, including a frangible expendable cap disposed over said other end of the fuse tube whereby when the fuse means double-vents the expendable cap is discharged by the hot gases into the expansion chamber.

13. A fault protection device according to claim 4, wherein said expansion chamber is made of a conductive material and has a preset deformation, contact means mounted on the deformed expansion chamber for electrically connecting the expansion chamber to the electrical circuit whereby, when the fuse means blows and double-vents, the hot gases alter the present deformation of the expansion chamber thereby moving the contact means to disconnect the expansion chamber from the electrical circuit.

14. A fault protection device according to claim 13, wherein said contact means comprises an L-shaped member affixed to the deformed expansion chamber and a torsional spring connected to the electrical circuit, said L-shaped member being engagable with the torsional spring.

15. A fault protection device for use in protecting an electrical circuit comprising:

a hollow bus;

fuse means for electrically connecting said hollow bus to the electrical circuit, said fuse means comprising a fusible link; and a fuse tube containing said fusible link, said fuse tube slidably extending into said hollow bus, means in said hollow bus for applying a force to said fuse tube to urge the same outwardly from said bus and means for releasing the outwardly directed force on said fuse tube and for retracting the fuse tube at least partly into the hollow bus when the fuse means blows to provide a visual indication that the fuse means has blown; and means in said hollow bus for pulling at least a portion of said fusible link into said hollow bus when said fuse means blows.

16. A fault protection device according to claim 15, wherein said force applying means and said pulling means each comprise a spring means.

17. A fault protection device according to claim 15, including a mounting plate removably affixed to the hollow bus, means in said mounting plate for slidably receiving the fuse tube of the fuse means, said force applying means and said pulling means comprising a first spring means pivotably connected to the mounting plate, said first spring means having a first portion connected to the fusible link so as to apply a tensile force thereto and a second portion engagable with the fuse means for applying a force thereto directed outwardly from the hollow bus.

18. A fault protection device according to claim 17, wherein said first spring means is a torsional spring.

19. A fault protection device according to claim 15, including a high voltage spring contact means for electrically connecting said fuse means to the electrical circuit, said fuse means being electrically disconnected from said spring contact means when the fuse tube is retracted partly into the hollow bus whereby the dielectric stress on the fuse tube is relieved.

20. A fault protection device according to claim 19, including an expansion chamber connected to the fuse tube between the fuse tube and the spring contact means, and said expansion chamber including means for electrically connecting the fusible link to the spring contact means.

21. A fault protection device according to claim 17, wherein said means for retracting the fuse tube partly into the hollow bus includes a second spring means interposed between the mounting plate and the fuse tube, said second spring means being biased to urge the fuse tube into the hollow bus.

22. A fault protection device according to claim 21, wherein said fuse tube includes an annular lip disposed at the end thereof extending into the hollow bus, said second spring means being disposed between the mounting plate and the annular lip, the second portion of said first spring means being engagable with said annular lip.

23. A fault protection device for use in protecting a plurality of electrical circuits comprising:

a hollow, electrically conductive bus; and a plurality of fuse means for electrically connecting said hollow bus to each of the electrical circuits, each of said fuse means comprising a double-vent expulsion-type fuse having a fusible link and a fuse tube, one end of said fuse tube of each fuse means extending into said hollow bus, and an expansion chamber mounted to the other end of each fuse tube, whereby hot gases discharged from the fuse tubes when the fuse means associated therewith blows are discharged into the hollow bus or into said hollow bus and said expansion chamber.

24. A fault protection device according to claim 23, including means in said hollow bus for pulling at least a portion of the fusible link of the blown fuse means into said hollow bus.

25. A fault protection device for use in protecting an electrical circuit comprising:

a hollow, electrically conductive bus;

fuse means for electrically connecting said hollow bus to the electrical circuit, said fuse means comprising a fusible link and a fuse tube;

means in said hollow bus for pulling at least a portion of said fusible link into said hollow bus when said fuse means blows; and means in said hollow bus for retracting the fuse tube at least partially into the hollow bus when said fuse means blows to provide a visual indication that the fuse means has blown.

26. A fault protection device according to claim 25, including high voltage spring contact means for electrically connecting the fuse means to the electrical circuit, said high voltage spring contact means being electrically disconnected from said fuse means when the fuse means is partially retracted into the hollow bus.

27. A fault protection device according to claim 25, wherein said fuse means further comprises a fuse tube containing said fusible link, said fuse tube slidably extending into said hollow bus, means in said hollow bus for applying a force to said fuse tube to urge the same outwardly from said bus and means for releasing the outwardly directed force on said fuse tube so that said retracting means retracts the fuse tube at least partially into the hollow bus when the fuse means blows.

28. A fault protection device according to claim 27, wherein said force applying means and said pulling means each comprise a spring means.

* * * * *

UNITED STATES PATENT AND TRADEMARK OFFICE

CERTIFICATE OF CORRECTION

PATENT NO. : 5,097,244

DATED : March 17, 1992

INVENTOR(S) : Edward F. VEVERKA et al

It is certified that error appears in the above-identified patent and that said Letters Patent is hereby corrected as shown below:

Column 11, line 22, "planer" should be --planar--.

IN THE CLAIMS"

Claim 5, column 12, line 10 "fush" should be --fuse--.

Claim 13, column 13, line 7, "present" should be --preset--.

Signed and Sealed this

Thirteenth Day of July, 1993

Michael K. Kirk

MICHAEL K. KIRK

*Acting Commissioner of Patents and Trademarks*

*Attest:*

*Attesting Officer*